US010309099B2

(12) United States Patent
Brigham et al.

(10) Patent No.: US 10,309,099 B2
(45) Date of Patent: Jun. 4, 2019

(54) DECK BOARD FASTENER METHODS

(71) Applicant: SIMPSON STRONG-TIE COMPANY INC., Pleasanton, CA (US)

(72) Inventors: Gueary Andrew Brigham, Hendersonville, TN (US); Jeremy Scott Park, Bethpage, TN (US)

(73) Assignee: SIMPSON STRONG-TIE COMPANY INC., Pleasanton, CA (US)

( * ) Notice: Subject to any disclaimer, the term of this patent is extended or adjusted under 35 U.S.C. 154(b) by 0 days.

(21) Appl. No.: 16/161,893

(22) Filed: Oct. 16, 2018

(65) Prior Publication Data

US 2019/0112802 A1 Apr. 18, 2019

Related U.S. Application Data

(62) Division of application No. 15/437,830, filed on Feb. 21, 2017, now Pat. No. 10,113,306.

(60) Provisional application No. 62/352,191, filed on Jun. 20, 2016.

(51) Int. Cl.

| | |
|---|---|
| ***E04B 1/41*** | (2006.01) |
| ***E04B 1/00*** | (2006.01) |
| ***E04F 15/02*** | (2006.01) |

(52) U.S. Cl.

CPC ..... *E04B 1/40* (2013.01); *E04B 1/003* (2013.01); *E04F 15/02044* (2013.01); *E04F 2015/02094* (2013.01)

(58) Field of Classification Search

CPC ..... E04B 1/003; E04B 1/40; E04F 15/02044; E04F 2015/02094

See application file for complete search history.

(56) References Cited

U.S. PATENT DOCUMENTS

| | | | |
|---|---|---|---|
| 1,184,080 | A | 5/1916 | DiArcy |
| 2,332,081 | A | 10/1943 | Hunt et al. |
| 2,362,252 | A | 11/1944 | Ellinwood |
| 2,398,603 | A | 4/1946 | Soderberg |

(Continued)

FOREIGN PATENT DOCUMENTS

| | | | |
|---|---|---|---|
| EP | 3266954 | A1 | 1/2018 |
| WO | 2010071930 | A1 | 7/2010 |

(Continued)

*Primary Examiner* — James M Ference

(74) *Attorney, Agent, or Firm* — Shartsis Friese LLP; Cecily Anne O'Regan

(57) ABSTRACT

Methods for attaching clips to decking. The clip includes a bottom and a removable top insert. The clip has a bottom made from a material that is different than the material used for the top. The clip has a generally T shape in a side view with a central bore passing through the top member and the bottom member to receive a screw or other fastening member, and a plurality of apertures through the top surface of the bottom member that engage the top member. The body of the bottom member has a transverse planar upper member and at least one perpendicularly positioned planar lower member or keel. The deck board fastener can also have a lip that projects upward from the upper surface of the transverse planar member. The lip can be positioned about an exterior edge of the transverse planar member or along the upper surface.

12 Claims, 10 Drawing Sheets

(56) References Cited

U.S. PATENT DOCUMENTS 2,406,387 A 8/1946 Lank
3,293,106 A 12/1966 Cocco et al.
3,458,618 A 7/1969 Burns et al.
3,845,860 A 11/1974 Ladouceur et al.
3,899,116 A 8/1975 Mims
3,973,151 A 8/1976 Bowcott
4,075,924 A * 2/1978 McSherry ..... F16B 13/0808 411/112
4,106,962 A 8/1978 Adams et al.
4,124,050 A * 11/1978 Ackerman ..... F16B 37/068 206/338
4,154,172 A * 5/1979 Curtis, Jr. ..... B61D 17/10 105/422
D253,865 S * 1/1980 Hagglund ..... D8/382
4,181,061 A * 1/1980 McSherry ..... F16B 13/0808 411/55
D270,516 S * 9/1983 Achille ..... D8/354
D272,043 S * 1/1984 Cowdroy ..... D8/382
4,449,346 A * 5/1984 Tremblay ..... E04B 1/617 52/471
4,454,699 A * 6/1984 Strobl ..... F16B 21/082 403/298
4,497,148 A * 2/1985 Lopez ..... E04B 1/617 52/126.3
4,527,375 A * 7/1985 Braginetz ..... E04B 1/2608 403/232.1
4,599,841 A * 7/1986 Haid ..... E04F 15/04 52/396.04
4,603,528 A 8/1986 Sigerist
4,641,988 A 2/1987 Ganner
D291,057 S * 7/1987 Shiraishi ..... 174/138 D
4,682,458 A 7/1987 Sparrow
4,704,057 A * 11/1987 McSherry ..... F16B 13/0808 411/344
4,716,704 A * 1/1988 Murr ..... E04F 19/065 52/471
4,736,507 A 4/1988 Berecz et al.
D295,496 S * 5/1988 Burke ..... D8/382
4,925,141 A * 5/1990 Classen ..... E04B 1/2612 248/217.2
5,004,027 A 4/1991 Legler et al.
5,056,286 A * 10/1991 Bokor ..... B07B 1/4645 52/483.1
5,071,280 A * 12/1991 Turner ..... E04B 1/2612 403/232.1
5,160,211 A * 11/1992 Gilb ..... E04F 11/181 256/65.02
D331,470 S * 12/1992 Mitchell ..... D25/119
5,182,891 A 2/1993 Slocum
5,243,804 A * 9/1993 Therrien ..... E04C 2/423 15/215
5,245,808 A * 9/1993 Grunewald ..... E06B 3/5427 52/204.593
5,250,058 A 10/1993 Miller et al.
5,251,996 A 10/1993 Hiller et al.
5,307,603 A 5/1994 Chiodo
5,351,392 A 10/1994 Wing et al.
5,359,954 A * 11/1994 Kordelin ..... B63B 3/68 114/84
D354,432 S * 1/1995 Starman ..... D8/382
5,377,732 A 1/1995 Fujii et al.
5,394,667 A * 3/1995 Nystrom ..... E01D 19/125 52/263
5,419,649 A * 5/1995 Gilb ..... E04B 1/2608 403/231
5,458,433 A 10/1995 Stastny
5,480,117 A 1/1996 Fleming, III
5,499,440 A 3/1996 Satoh et al.
5,529,428 A 6/1996 Bischof
5,564,248 A * 10/1996 Callies ..... E04B 1/2612 403/232.1
5,603,580 A * 2/1997 Leek ..... E04B 1/2612 403/168
5,619,834 A * 4/1997 Chen ..... E04F 13/0855 52/126.1
D380,667 S * 7/1997 Kanamori ..... D8/382
D382,466 S * 8/1997 Hirose ..... D8/382
5,660,016 A 8/1997 Erwin et al.
5,704,181 A * 1/1998 Fisher ..... E04B 1/24 52/338
D392,877 S * 3/1998 Eguchi ..... D8/382
5,730,544 A * 3/1998 Dils ..... F16B 12/04 403/13
5,743,672 A * 4/1998 Cline ..... A47C 19/005 403/231
5,746,535 A 5/1998 Kohler
D396,406 S * 7/1998 Eguchi ..... D8/382
D410,194 S * 5/1999 Hilton ..... D8/382
D413,508 S * 9/1999 Shibao ..... D8/382
6,012,256 A * 1/2000 Aschheim ..... E04B 1/24 52/167.1
6,032,431 A * 3/2000 Sugiyama ..... E04B 1/2604 52/656.9
D427,050 S * 6/2000 Bryan ..... D8/382
D435,433 S * 12/2000 Miller ..... D8/354
6,298,533 B1 10/2001 Nishimura et al.
6,314,699 B1 11/2001 West
D451,785 S * 12/2001 Chaney ..... D8/354
6,363,677 B1 * 4/2002 Chen ..... E04F 15/02 52/384
6,367,224 B1 * 4/2002 Leek ..... E04B 1/2604 403/187
6,402,415 B1 6/2002 Eberle, III
D461,116 S * 8/2002 Aoki ..... D11/220
6,440,525 B1 8/2002 Kessler et al.
D462,255 S * 9/2002 Aoki ..... D11/220
D462,601 S * 9/2002 Chaney ..... D25/119
6,442,908 B1 * 9/2002 Naccarato ..... E04B 5/43 52/236.8
6,449,918 B1 * 9/2002 Nelson ..... E04F 15/04 52/570
D464,873 S * 10/2002 Nemoto ..... D8/382
6,460,306 B1 * 10/2002 Nelson ..... E04F 15/04 52/570
6,470,641 B1 10/2002 Faure
6,471,434 B2 * 10/2002 Chin ..... A47B 13/06 312/140
6,484,467 B2 * 11/2002 Crout ..... E04B 5/12 52/302.1
D470,039 S 2/2003 Pelc
6,651,398 B2 11/2003 Gregori
6,652,208 B2 * 11/2003 Gillis ..... F16B 5/0208 411/107
D484,779 S * 1/2004 Shibuya ..... D8/382
D485,160 S * 1/2004 Pelc ..... E04F 15/04 D8/382
6,711,864 B2 3/2004 Erwin
D488,373 S 4/2004 Eberle
6,810,633 B2 11/2004 Harris
6,851,884 B2 2/2005 Eberle
6,871,467 B2 3/2005 Hafner
D504,609 S * 5/2005 Ferguson ..... D8/354
D515,910 S * 2/2006 Gates ..... B60R 9/06 D8/354
6,997,659 B2 * 2/2006 Vrana ..... F16B 37/068 411/179
7,052,200 B2 5/2006 Harris
D547,168 S * 7/2007 Churchill ..... D8/382
D547,169 S 7/2007 Harris
D554,976 S * 11/2007 Hutter, III ..... D8/354
D556,017 S * 11/2007 Hutter, III ..... D8/354
7,299,598 B2 * 11/2007 Gembala ..... E04B 5/40 52/353
D562,122 S * 2/2008 Leman ..... D23/386
7,383,663 B2 6/2008 Pacione
D573,454 S * 7/2008 Eberle, III ..... D8/382
7,398,623 B2 * 7/2008 Martel ..... E04B 5/12 411/461
7,409,803 B2 8/2008 Grohman

(56) References Cited

U.S. PATENT DOCUMENTS 7,427,180 B2 * 9/2008 Ladoucer ..... B23P 19/062 411/181
D589,334 S * 3/2009 Hotchkiss, III ..... D8/382
7,496,993 B2 * 3/2009 Kosidlo ..... F16B 5/0621 24/295
7,516,586 B2 * 4/2009 Riccitelli ..... A47B 96/06 52/582.1
7,578,105 B2 8/2009 Eberle
D600,105 S * 9/2009 Harris ..... D8/382
D601,881 S * 10/2009 Aichmann ..... D8/382
7,600,353 B2 10/2009 Hafner
7,603,814 B1 * 10/2009 Hartmann ..... G09F 7/18 24/569
D604,599 S 11/2009 Prichard, Jr. et al.
D610,440 S 2/2010 Prichard, Jr. et al.
D615,847 S * 5/2010 Tezak ..... D8/349
D621,245 S * 8/2010 Heindl ..... D8/382
D621,246 S * 8/2010 Heindl ..... D8/382
D622,131 S * 8/2010 Tezak ..... D8/349
D622,579 S * 8/2010 Heindl ..... D8/382
7,805,902 B2 10/2010 Martel
7,874,113 B2 1/2011 Eberle
7,984,599 B2 7/2011 Snell et al.
8,011,153 B2 * 9/2011 Orchard ..... E04F 15/02 24/295
8,066,464 B1 * 11/2011 Van Dyke ..... E04F 15/04 411/458
D658,044 S * 4/2012 Cheng ..... D8/382
8,161,702 B2 4/2012 Eberle
8,191,327 B2 * 6/2012 Griffiths ..... E04F 13/0825 24/457
D664,836 S 8/2012 Kikuchi
D665,657 S * 8/2012 Pelc ..... D8/354
8,256,614 B1 9/2012 Wadsworth, Sr.
8,287,206 B2 10/2012 Eberle
8,291,666 B1 * 10/2012 Garrison ..... E04B 1/003 52/177
D671,394 S * 11/2012 Derry ..... D8/373
8,393,125 B2 * 3/2013 Martel ..... E04F 15/04 52/489.1
8,464,488 B2 6/2013 Pelc
8,544,229 B2 * 10/2013 Kilgore ..... E04F 15/02044 52/177
8,615,958 B2 * 12/2013 Kilgore ..... E04F 15/02044 52/650.3
D697,390 S * 1/2014 Petry ..... D8/382
D708,936 S * 7/2014 Bridgewater ..... D8/356
8,806,829 B2 8/2014 Pelc et al.
D713,242 S * 9/2014 Magan ..... D8/396
9,003,624 B2 4/2015 Wadsworth
D731,874 S * 6/2015 Lin ..... D8/349
D732,925 S * 6/2015 Lin ..... D8/349
D738,194 S * 9/2015 Baldoni ..... D8/354
D740,113 S * 10/2015 Olenick ..... D8/399
9,200,456 B2 * 12/2015 Murphy ..... E04F 13/0801
D751,369 S * 3/2016 Baldoni ..... D8/354
D769,109 S * 10/2016 Kaiser ..... D8/382
D774,385 S * 12/2016 Kaiser ..... D8/382
D792,757 S 7/2017 Brigham et al.
D795,049 S 8/2017 Brigham et al.
D796,305 S 9/2017 Brigham et al.
D796,306 S 9/2017 Brigham et al.
10,113,306 B2 10/2018 Brigham et al.
2002/0056238 A1 5/2002 Leines
2002/0059766 A1 5/2002 Gregori
2002/0095897 A1 7/2002 Summerford
2002/0121064 A1 9/2002 Erwin
2003/0123924 A1 7/2003 Eberle
2004/0020152 A1 * 2/2004 Harris, Sr. ..... E04B 5/12 52/582.1
2004/0045244 A1 * 3/2004 Hafner ..... E04B 5/12 52/489.1
2004/0182034 A1 * 9/2004 Eberle, III ..... E04F 15/04 52/586.1
2004/0184878 A1 * 9/2004 Eberle, III ..... E04F 15/04 403/408.1
2005/0063771 A1 * 3/2005 Harris ..... E04F 15/04 403/294
2005/0252156 A1 * 11/2005 Martel ..... E04B 5/12 52/714
2006/0053720 A1 3/2006 Oh
2006/0107612 A1 5/2006 Pelc
2006/0147672 A1 7/2006 Ruiz
2006/0242916 A1 11/2006 Simko et al.
2006/0283122 A1 12/2006 Burgess et al.
2007/0066096 A1 * 3/2007 Gillis ..... E04F 15/02 439/76.1
2007/0289249 A1 * 12/2007 Martel ..... E04F 15/02 52/715
2008/0222993 A1 * 9/2008 Prichard ..... E04F 15/02005 52/702
2008/0279654 A1 11/2008 Deschamps
2009/0019805 A1 1/2009 Zanelli
2009/0217495 A1 * 9/2009 Tipps ..... E04F 15/02 24/458
2009/0223027 A1 * 9/2009 Reznar ..... E04F 15/04 24/457
2009/0282771 A1 11/2009 Gibson et al.
2010/0180532 A1 * 7/2010 Martel ..... E04F 15/04 52/650.3
2010/0257806 A1 * 10/2010 Snell ..... E01C 5/005 52/483.1
2011/0123290 A1 * 5/2011 Wadsworth ..... E04F 15/02 411/103
2011/0192112 A1 * 8/2011 Pelc, Jr. ..... E04F 15/02 52/705
2011/0314765 A1 * 12/2011 Martel ..... E04F 15/02044 52/745.05
2012/0110944 A1 * 5/2012 Hess ..... E04F 15/02044 52/582.1
2013/0022392 A1 1/2013 Eberle, III
2013/0104493 A1 5/2013 Orchard
2013/0247504 A1 * 9/2013 Pelc ..... E04F 15/02 52/704
2013/0340377 A1 * 12/2013 Shadwell ..... E04F 15/04 52/698
2014/0174025 A1 6/2014 Kinnunen et al.
2014/0186109 A1 7/2014 Wadsworth
2014/0294535 A1 10/2014 Waterman et al.
2015/0275951 A1 * 10/2015 Shadwell ..... E04F 15/02044 411/511
2015/0354204 A1 * 12/2015 Kinnunen ..... E04F 15/02044 248/228.5
2017/0232499 A1 * 8/2017 Wadsworth ..... E04F 15/02 29/428
2017/0362815 A1 * 12/2017 Brigham ..... E04B 1/003

FOREIGN PATENT DOCUMENTS

WO 2013076585 A2 5/2013
WO 2014128340 A1 8/2014
WO 2014179838 A1 11/2014

* cited by examiner

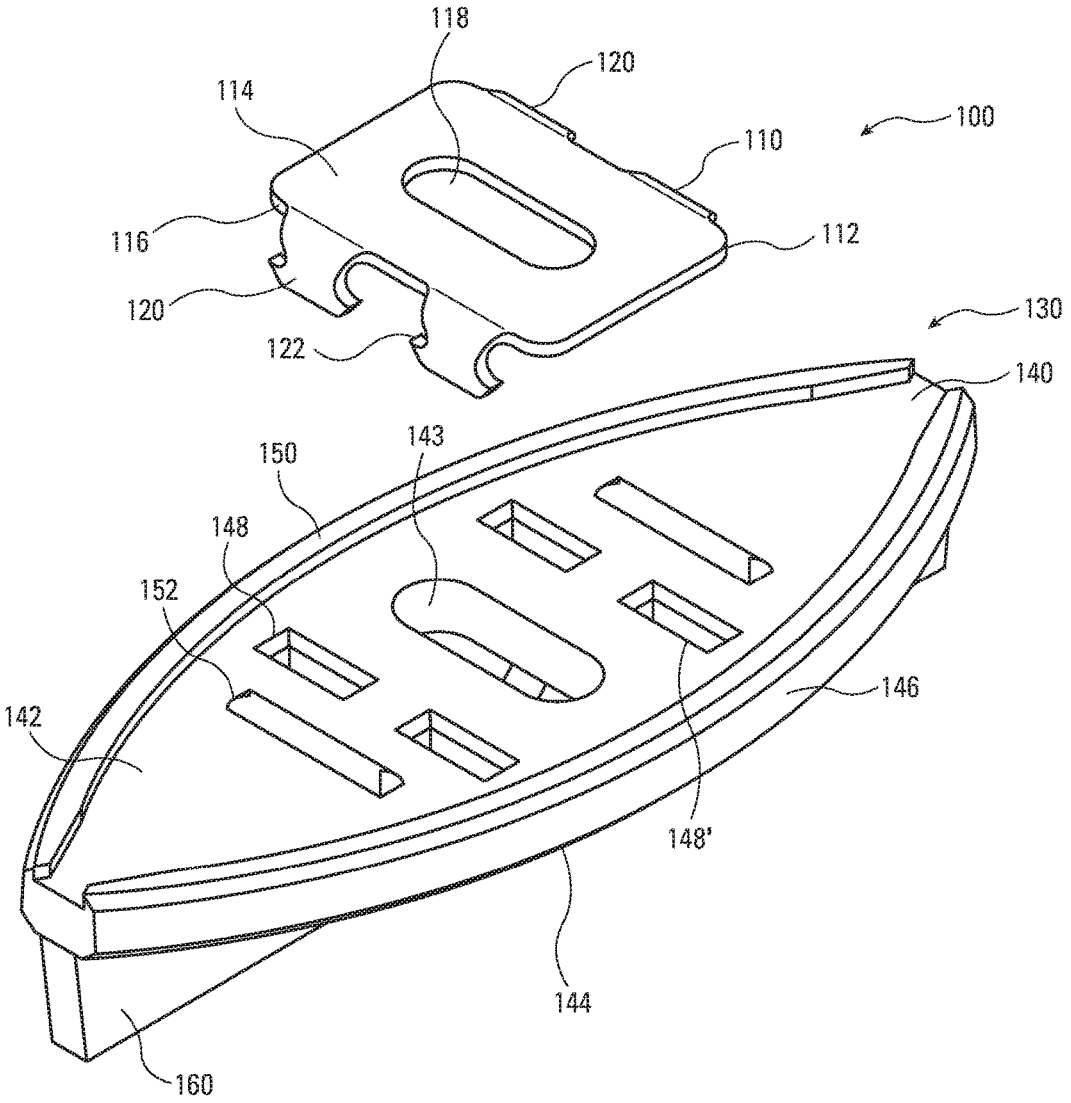
Figs. 1A-B

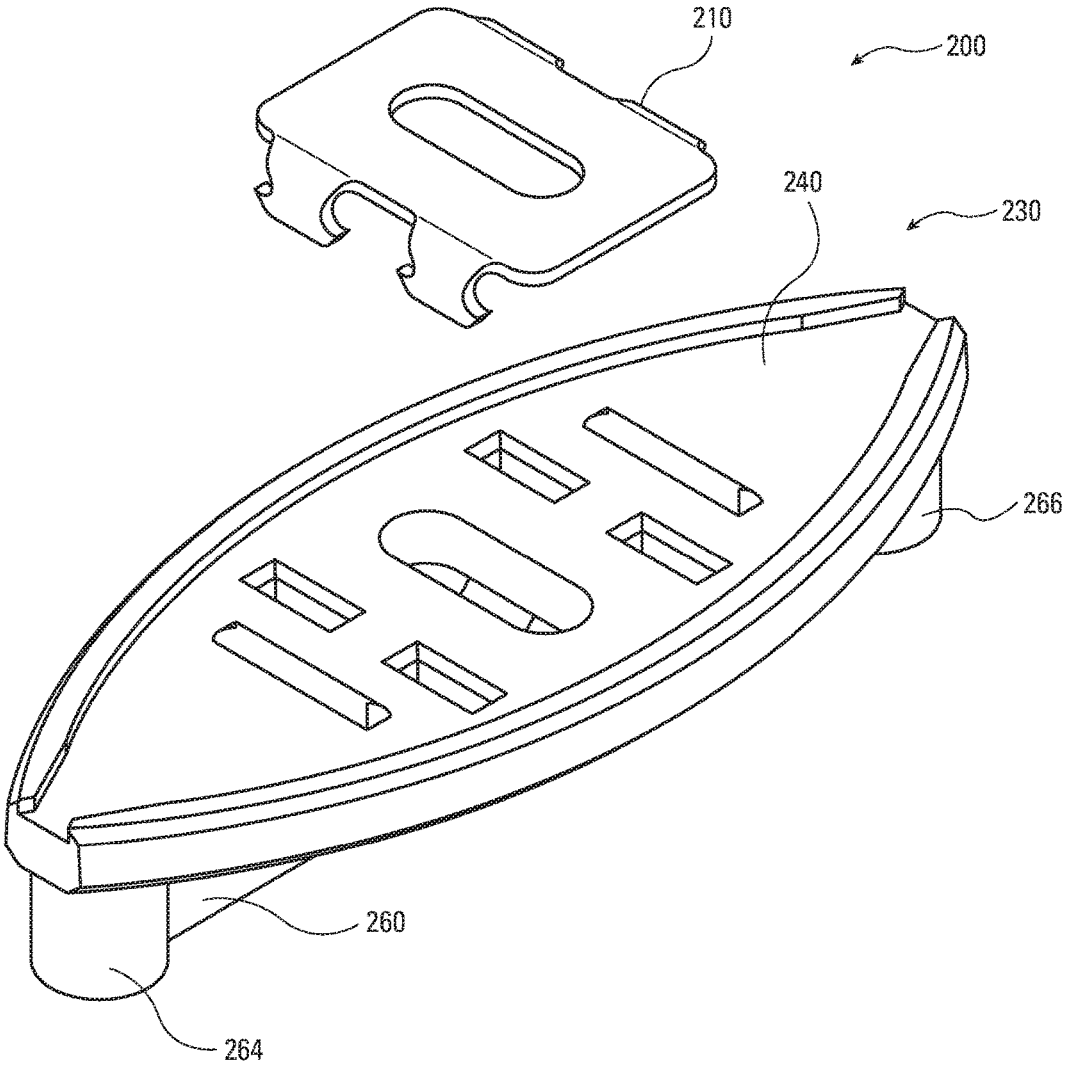
Figs. 2A-B

DECK BOARD FASTENER METHODS

CROSS-REFERENCE

This application is a divisional patent application of U.S. Utility application Ser. No. 15/437,830 filed Feb. 21, 2017, now U.S. Pat. No. 10,113,306, which claims the benefit of U.S. Provisional Application No. 62/352,191, filed Jun. 20, 2016, entitled Deck Board Fasteners and Methods which applications are incorporated herein by reference.

BACKGROUND

The disclosure relates to deck construction. More particularly, deck board fastening devices or fastener devices for retaining adjacent boards to a support joist in a spaced alignment in a constructed deck.

SUMMARY

An aspect of the disclosure is directed to deck board fastening devices. Deck board fasteners have a body which is connectable to a metal clip or insert. The body has a transverse planar upper member and at least one perpendicularly positioned planar lower member or keel. An aperture through the clip and transverse planar upper member allows an anchoring device, such as a screw to secure the deck board fastener to a joist during use. In some configurations, the aperture can also pass through the planar lower member or keel. The deck board fastener can also have a lip that projects upward from the upper surface of the transverse planar member. The lip can be positioned about an exterior edge of the transverse planar member or along the upper surface. A guide member on the lower surface of the transverse planar member can be positioned to guide the anchoring device at an angle to optimize entry of the anchoring device into the joist. The shape of the transverse planar upper member can be, for example, oval, biscuit, square, rectangular, or bowtie. In some configurations, the metal clip or insert is inset in the transverse planar upper member.

An aspect of the disclosure is directed to decking clips. Decking clips comprise: a body having a transverse upper member with an upper surface and a lower surface and a perpendicular member extending from the lower surface of the body with a central bore therethrough and one or more clip anchor apertures positioned about the central bore; and a clip having an upper surface and a lower surface, a central aperture therethrough, and two or more anchors positioned along at least one edge of the clip and extending downward away from the lower surface of the clip. The body of the decking clip can be formed of a first material and the clip is formed of a second material. The decking clip can have a generally T-shaped side view. Additionally, the transverse upper member has a shape selected from biscuit, bowtie, rectangular, and oval. A first axis of the transverse upper member can be longer than a second perpendicular axis of the transverse upper member. One or more stabilizers can be provided which extend from the upper surface of the transverse upper member which are substantially perpendicular to a plane formed by the perpendicular member. Additionally, a second perpendicular member can be provided which extends from the lower surface of the body. The perpendicular member extending from the lower surface of the body can have a uniform thickness. In some configurations, the perpendicular member can extend from the lower surface of the body has a first thickness at a first end and a second thickness at a second end. The perpendicular member can also extend from the lower surface of the body has a rounded first end and a rounded second end. In some configurations, a tubular member is provided which extends from the lower surface of the body along the length of the perpendicular member. A guide member can also be provided which extends from the lower surface of the body adjacent the perpendicular member and the central aperture.

Another aspect of the disclosure is directed to methods of assembling a deck structure. The methods comprise: providing a joist member; providing a plurality of deck boards, each having laterally opposing side edges with a groove therein arranged to span across the joist member parallel and laterally adjacent to one another and transversely to the longitudinal direction of the joist member; providing a plurality of mounting clips, wherein each mounting clip comprises a body having a transverse upper member with an upper surface and a lower surface and a perpendicular member extending from the lower surface of the body with a central bore therethrough and one or more clip anchor apertures positioned about the central bore, and a clip having an upper surface and a lower surface, a central aperture therethrough, and two or more anchors positioned along at least one edge of the clip and extending downward away from the upper surface of the clip; positioning a portion of the transverse upper member in the groove in the board; and securing the deck clip to the joist by passing a fastening device through the clip aperture and the central aperture. Additionally, the body of the decking clip can be formed of a first material and the clip is formed of a second material. Moreover, the decking clip can have a generally T-shaped side view. In some instances, the transverse upper member of the decking clip can have a shape selected from biscuit, bowtie, rectangular, and oval. Additionally, a first axis of the transverse upper member of the decking clip can be longer than a second perpendicular axis of the transverse upper member of the decking clip. The decking clip can further comprises one or more stabilizers extending from the upper surface of the transverse upper member which are substantially perpendicular to a plane formed by the perpendicular member. A second perpendicular member can also be provided which extends from the lower surface of the body. In some instances, the perpendicular member of the decking clip extends from the lower surface of the body has a uniform thickness. Alternatively or additionally, the perpendicular member of the decking clip can extend from the lower surface of the body has a first thickness at a first end and a second thickness at a second end. The perpendicular member extending from the lower surface of the body can also have a rounded first end and a rounded second end. A tubular member can be provided which extends from the lower surface of the body along the length of the perpendicular member. A guide member can also be provided which extends from the lower surface of the body adjacent the perpendicular member and the central aperture.

Still another aspect of the disclosure is directed to decking clips. Decking clips comprise: a body having a transverse upper member means with an upper surface and a lower surface and a perpendicular member means extending from the lower surface of the body with a central bore therethrough and one or more clip anchor apertures positioned about the central bore; and a clip having an upper surface and a lower surface, a central aperture therethrough, and two or more anchors positioned along at least one edge of the clip and extending downward away from the lower surface of the clip. The body of the decking clip means can be formed of a first material and the clip is formed of a second material. The decking clip means can have a generally T-shaped side view. Additionally, the transverse upper member means has a shape selected from biscuit, bowtie, rectangular, and oval. A first axis of the transverse upper member means can be longer than a second perpendicular axis of the transverse upper member. One or more stabilizers can be provided which extend from the upper surface of the transverse upper member means which are substantially perpendicular to a plane formed by the perpendicular member means. Additionally, a second perpendicular member means can be provided which extends from the lower surface of the body. The perpendicular member means extending from the lower surface of the body can have a uniform thickness. In some configurations, the perpendicular member means can extend from the lower surface of the body has a first thickness at a first end and a second thickness at a second end. The perpendicular member means can also extend from the lower surface of the body has a rounded first end and a rounded second end. In some configurations, a tubular member is provided which extends from the lower surface of the body along the length of the perpendicular member means. A guide member can also be provided which extends from the lower surface of the body adjacent the perpendicular member means and the central aperture.

Yet another aspect of the disclosure is directed to methods of assembling a deck structure. The methods comprise: providing a joist member; providing a plurality of deck boards, each having laterally opposing side edges with a groove therein arranged to span across the joist member parallel and laterally adjacent to one another and transversely to the longitudinal direction of the joist member; providing a plurality of mounting clips, wherein each mounting clip comprises a body having a transverse upper member means with an upper surface and a lower surface and a perpendicular member means extending from the lower surface of the body with a central bore therethrough and one or more clip anchor apertures positioned about the central bore, and a clip having an upper surface and a lower surface, a central aperture therethrough, and two or more anchors positioned along at least one edge of the clip and extending downward away from the upper surface of the clip; positioning a portion of the transverse upper member means in the groove in the board; and securing the deck clip to the joist by passing a fastening device through the clip aperture and the central aperture. Additionally, the body of the decking clip means can be formed of a first material and the clip is formed of a second material. Moreover, the decking clip means can have a generally T-shaped side view. In some instances, the transverse upper member means of the decking clip means can have a shape selected from biscuit, bowtie, rectangular, and oval. Additionally, a first axis of the transverse upper member means of the decking clip means can be longer than a second perpendicular axis of the transverse upper member of the decking clip. The decking clip means can further comprises one or more stabilizers extending from the upper surface of the transverse upper member means which are substantially perpendicular to a plane formed by the perpendicular member means. A second perpendicular member means can also be provided which extends from the lower surface of the body. In some instances, the perpendicular member means of the decking clip means extends from the lower surface of the body has a uniform thickness. Alternatively or additionally, the perpendicular member means of the decking clip means can extend from the lower surface of the body has a first thickness at a first end and a second thickness at a second end. The perpendicular member means extending from the lower surface of the body can also have a rounded first end and a rounded second end. A tubular member can be provided which extends from the lower surface of the body along the length of the perpendicular member means. A guide member can also be provided which extends from the lower surface of the body adjacent the perpendicular member means and the central aperture.

INCORPORATION BY REFERENCE

All publications, patents, and patent applications mentioned in this specification are herein incorporated by reference to the same extent as if each individual publication, patent, or patent application was specifically and individually indicated to be incorporated by reference. Prior deck board fastening devices are disclosed in, for example, U.S. Pat. No. 3,845,860 A issued Nov. 5, 1974 to Ladouceur et al. for "Fastener Strip,"

U.S. Pat. No. 4,106,962 A issued Aug. 15, 1978 to Adams et al. for "Method of Fastening Metal Part to Plastic Part;"

U.S. Pat. No. 6,402,415 B1 issued Jun. 11, 2002, to Eberle for "Anchoring Biscuit Device;"

U.S. Pat. No. 6,851,884 B2 issued Feb. 8, 2005, to Eberle for "Decking Anchor Device;"

U.S. Pat. No. 7,052,200 B2 issued May 30, 2006, to Harris for "Resilient Deck Board Fastener;"

U.S. Pat. No. 7,409,803 B2 issued Aug. 12, 2008, to Groham for "Hidden Deck Fastener System;"

U.S. Pat. No. 7,578,105 B2 issued Aug. 25, 2009 to Eberle for "Expansion-Compensating Deck Fastener;"

U.S. Pat. No. 7,805,902 B2 issued Oct. 5, 2010 to Martel for "Fastener for Grooved or Slotted Decking Members;"

U.S. Pat. No. 7,874,113 B2 issued Jan. 25, 2011 to Eberle for "Expansion-Compensating Deck Fastener;"

U.S. Pat. No. 7,984,599 B2 issued Jul. 26, 2011, to Snell et al., for "Hidden Decking Fastener and Related Method of Fastening Deck Boards;"

U.S. Pat. No. 8,161,702 B2 issued Apr. 24, 2012, to Eberle for "Expansion-Compensating Deck Fastener;"

U.S. Pat. No. 8,256,614 B1 issued Sep. 4, 2012, to Wadsworth for "Interconnected and On-site Severable Deck Clips with Cooperating Installation Tool for Joining Two Adjacent Decking Plants to an Underlying Support Structure;"

U.S. Pat. No. 8,464,488 B2 issued Jun. 18, 2013 to Pelc, Jr. for "Anchoring Device;" and U.S. Pat. No. 9,003,624 B2 issued Apr. 14, 2015, to Wadsworth for "Method for Making a Gangable Composite Clip for Attaching Decking."

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

FIGS. 1A-I illustrate a configuration for a deck board fastening device where FIG. 1A illustrates a clip from a top perspective view, FIG. 1B illustrates a deck board fastening device body from a top perspective view, FIG. 1C illustrates a deck board fastening device with the clip engaging the deck board fastening body from a top perspective view; FIG. 1D illustrates a deck board fastening device with the clip engaging the deck board fastening body from a bottom perspective view, FIG. 1E illustrates a deck board fastening device from a side view, FIG. 1F illustrates a deck board fastening device from a top view; FIG. 1G illustrates a cross-sectional side view of a deck board fastening device along the lines G-G shown in FIG. 1F, FIG. 1H illustrates a cross-sectional side view of a deck board fastening device along the lines H-H shown in FIG. 1F, FIG. 1I illustrates a cross-sectional side view of a deck board fastening device along the lines I-I shown in FIG. 1F;

FIGS. 2A-E illustrate another configuration for a deck board fastening device where FIG. 2A illustrates a clip from a top perspective view, FIG. 2B illustrates a deck board fastening device body from a top perspective view, FIG. 2C illustrates a deck board fastening device with the clip engaging the deck board fastening body from a top perspective view; FIG. 2D illustrates a deck board fastening device with the clip engaging the deck board fastening body from a bottom perspective view, FIG. 2E illustrates a deck board fastening device from a side view;

FIGS. 3A-D illustrate another configuration for a deck board fastening device where FIG. 3A illustrates a clip from a top perspective view, FIG. 3B illustrates a deck board fastening device body from a top perspective view, FIG. 3C illustrates a deck board fastening device with the clip engaging the deck board fastening body from a top perspective view; FIG. 3D illustrates a deck board fastening device with the clip engaging the deck board fastening body from a bottom perspective view;

FIGS. 4A-D illustrate another configuration for a deck board fastening device where FIG. 4A illustrates a clip from a top perspective view, FIG. 4B illustrates a deck board fastening device body from a top perspective view, FIG. 4C illustrates a deck board fastening device with the clip engaging the deck board fastening body from a top perspective view; FIG. 4D illustrates a deck board fastening device with the clip engaging the deck board fastening body from a bottom perspective view;

DETAILED DESCRIPTION

Figure 1D:
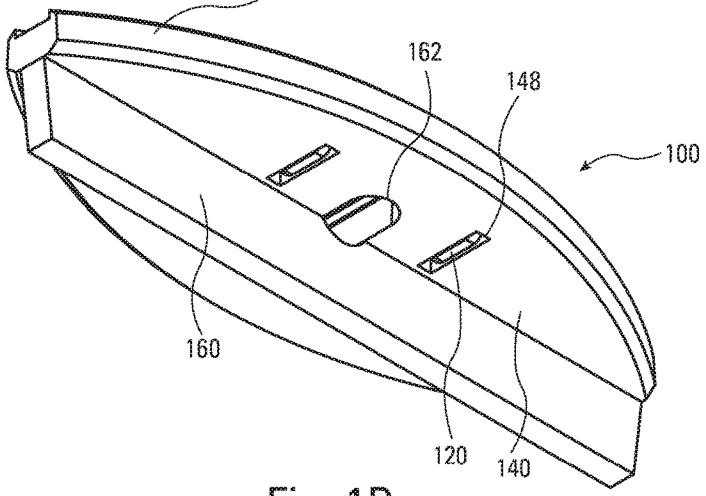

FIGS. 1A-I illustrate a configuration for a deck board fastening device 100. The deck board fastening device 100 has a clip 110 and a deck board fastening device body 130. The clip 110 has a plate 112 with a planar upper surface 114 and a lower surface 116 and a clip aperture 118 positioned through the plate 112. Two or more clip anchors 120, 120' can extend from the plate 112. The two or more clip anchors 120, 120' can be integrally formed with the plate 112 such that one or more of the two or more anchors can be part of the clip 110 or can be formed such that the clip 110 operates as a single piece even where the one or more of the two or more clip anchors 120, 120' are formed from a separate piece which is adhered to the plate 112. The one or more clip anchors 120, 120' can have a notch 122 on one or both sides of each of the two or more clip anchors 120, 120'. The notch 122 is configured to secure the clip anchor 120 through an anchor receiving aperture 148 in the transverse upper member.

As an example, the planar upper surface 114 of the clip 110 can have a dimension of from 0.45 to 0.70 inches in a first dimension, 0.65 to 0.85 inches in a second dimension and a thickness of from 0.02 inches to 0.04 inches, more preferably about 0.51 inches in a first dimension, about 0.75 inches in a second dimension and a thickness of 0.03 inches. The clip aperture 118 in the plate 112 can have an oval shape which is 0.44 inches in a first dimension and 0.155 inches in a second dimension. The clip anchors 120, 120' can extend laterally from the planar upper surface 114 before translating perpendicularly, or substantially perpendicularly, away from the planar upper surface 114. Thus, the width of the clip 110 at a location where an clip anchor 120 extends from both sides of the planar upper surface 114 can be from 0.55 inches to 0.65 inches, while the width of the clip 110 at a location where two anchors extend on either side can be for example, from 0.62 inches to 0.59 inches. The length of the clip anchor 120 from the top of the planar upper surface 114 can be from 0.10 inches to 0.20 inches, more preferably about 0.14 inches. The distance between a first clip anchor 120 and a second clip anchor 120' on opposing sides of the planar upper surface 114 can be from 0.50 inches to 0.60 inches, more preferably about 0.51 inches. The distance between two clips on the same side of the planar upper surface 114 can be from 0.10 inch to 0.20 inch, more preferably about 0.156 inch.

In some configurations, the clip anchor 120 is a plate that fits within a recess on a transverse upper member 140. Two or more apertures can be provided to secure the clip anchor 120 to the transverse upper member 140, where, for example, a post extends from the upper surface of the transverse upper member 140.

Suitable materials for the plate include, but are not limited to metal, exterior grade metal, and stainless steel. However, other materials may be used without departing from the scope of the disclosure. Typically the hardness of the material comprising the clip 110 is greater than the hardness of the material comprising the deck board fastening device body 130.

The deck board fastening device body 130 can have a transverse upper member 140 and at least one perpendicularly positioned lower member 160, or keel, which extends perpendicularly from a lower surface 144 of the transverse upper member 140. The transverse upper member 140 has an upper surface 142 and a lower surface 144. The shape of the transverse upper member 140 can be biscuit-shaped with two curved opposing sides forming an arc from a top view. The arcs can have predetermined radii and arc lengths. The arced side can terminate at an end wall at either end. Two or more anchor receiving apertures 148, 148' can be provided to receive the two or more clip anchors 120, 120' from the clip 110. The anchors can pass completely through the two or more anchor receiving apertures 148, 148', or be received into the aperture without passing through the entire transverse upper member 140.

The transverse upper member 140 can have a variety of shapes in a first plane including, for example, oval, biscuit, square, rectangular, or bowtie. As illustrated in FIG. 1, the transverse upper member 140 has a biscuit shape. A virtual centerline passes along a length of the transverse upper member 140.

A lip 150 can extend upward from the upper surface 142 of the transverse upper member 140. The lip 150 can be positioned at or near a side wall 146 of the transverse upper member 140 as illustrated, or on the upper surface 142 such that the lip 150 is positioned around a perimeter of a the plate 112 retaining area of the clip 110. Additionally, one or more stabilizers 152 can be provided along the transverse upper member 140 which are positioned perpendicular, or substantially perpendicular, to a plane formed by the perpendicularly positioned lower member 160 and a plane formed by the transverse upper member 140. The height of the lip 150 from the upper surface 142 of the transverse upper member 140 can correspond to the thickness of the plate 112 of the clip 110. Where the height of the lip 150 corresponds to the thickness of the plate 112, the upper surface of the lip 150 and the upper surface of the plate 112, when engaging the deck board fastening device body 130, would be positioned in the same plane. In other configurations, the height of the lip 150 from the upper surface 142 of the transverse upper member 140 can be greater or less than the thickness of the plate 112 of the clip 110 without departing from the scope of the disclosure. By correlating the height of the lip 150 to the thickness of the clip 110, during use the lip 150 will prevent the clip 110 from being damaged or inadvertently removed. A central aperture 143 corresponding at least partially to the clip aperture 118 passes through the transverse upper member 140.

The transverse upper member 140 of the deck board fastening device body 130 can have a first dimension of from 2.0 inches to 2.5 inches, a second dimension of 0.8 inches to 1.1 inches and a thickness of from 0.10 inches to 0.20 inches; more preferably a first dimension of about 2.3 inches, a second dimension of about 0.97 inches, and a thickness of about 0.15 inches. Two sides can be arced, terminating in an end having a length of from 0.90 inches to 1.10 inches, more preferably about 0.10 inches. The perpendicularly positioned lower member 160 can have a height of from the top of the transverse upper member 140 to the lower surface 163 of the perpendicularly positioned lower member 160 of from 0.35 inches to 0.45 inches, and more preferably about 0.40 inches.

As shown in FIGS. 1A-B the clip 110 is positioned above the deck board fastening device body 130 from an upper perspective view. FIG. 1C illustrates the deck board fastening device 100 with the clip 110 engaging the deck board fastening device body 130 with the clip anchor 120 passing through the anchor receiving aperture 148 so that the lower surface of the clip is adjacent the upper surface of the transverse upper member 140 of the deck board fastening device body 130.

Figure 1C:
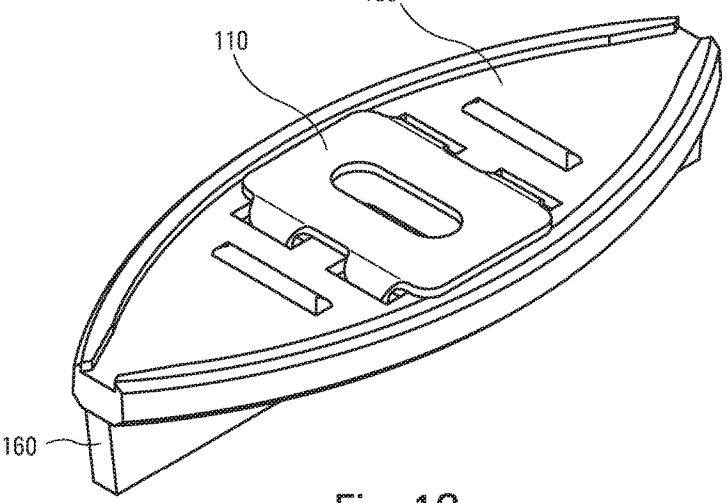
Figure 1E:
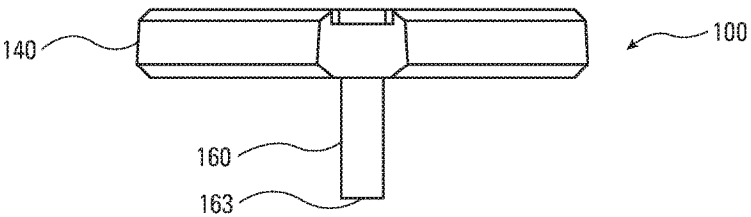

FIG. 1D is a perspective view of a bottom surface of the deck board fastening device 100. The clip anchors 120 can be seen passing through an anchor receiving aperture 148. As will be appreciated by those skilled in the art, the anchor receiving aperture 148 need not pass entirely through the transverse upper member 140 of the deck board fastening device body 130, provided the anchor receiving aperture 148 is configured to engage the clip anchor 120 extending from the clip 110. Additionally, the perpendicularly positioned lower member 160 can have a guide member 162 which extends from the bottom surface of the deck board fastening device body 130 and engages the perpendicularly positioned lower member 160 on one end of the guide member 162. FIG. 1E is a side view of a deck board fastening device 100 showing the transverse upper member 140 and the perpendicularly positioned lower member 160.

Figure 1F:
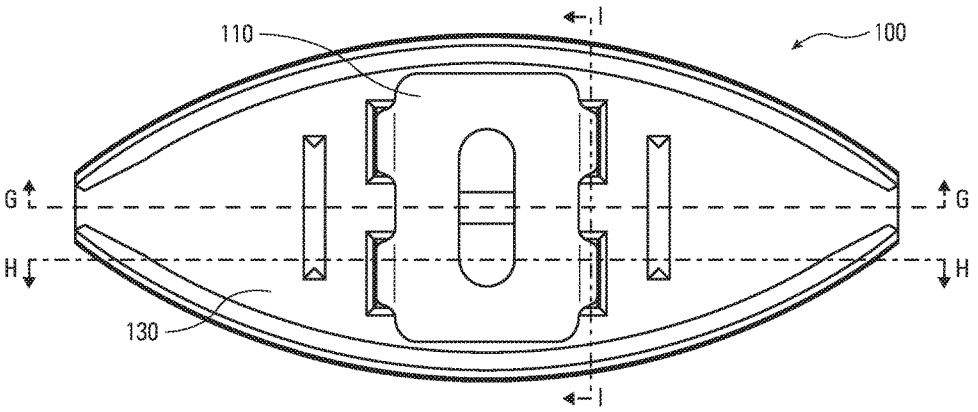
Figure 1G:
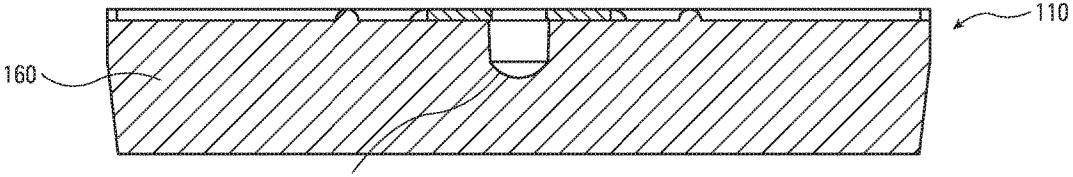

FIG. 1F is a top plan view of a deck board fastening device 100 with the clip 110 engaging the deck board fastening device body 130. FIG. 1G is a cross-section of the deck board fastening device 100 shown in FIG. 1F along the lines G-G.

Figure 1I:
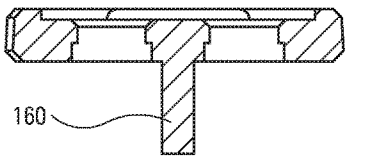
Figure 1H:
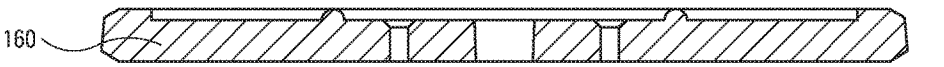
Figure 2D:
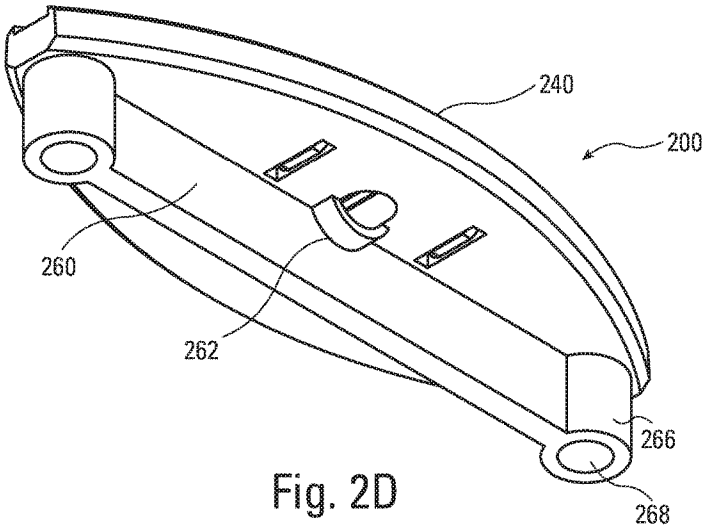
Figure 2C:
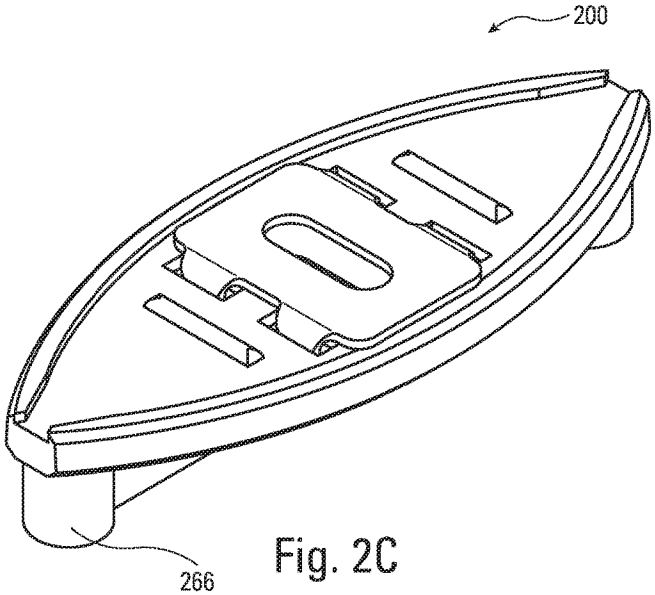
Figure 2E:
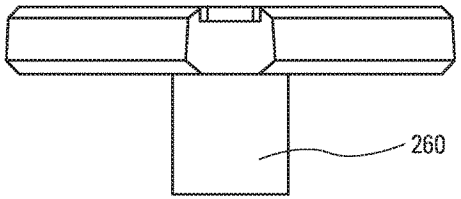
Figure 3C:
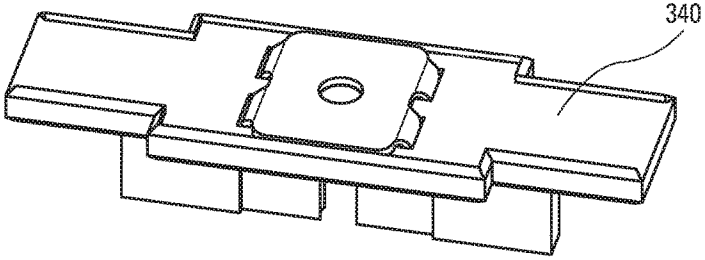
Figure 3D:
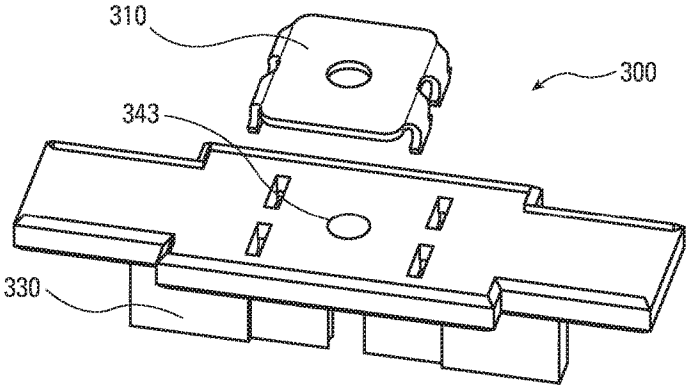
Figure 3D:
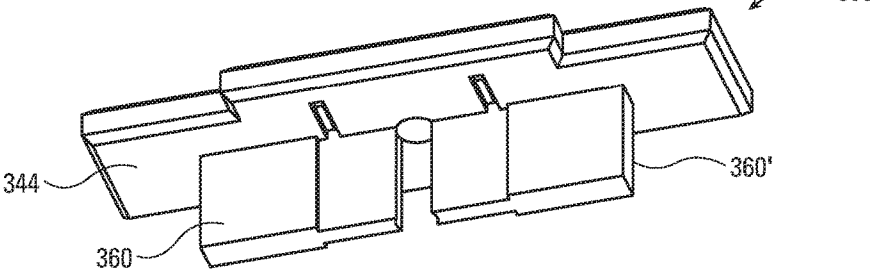
Figure 4C:
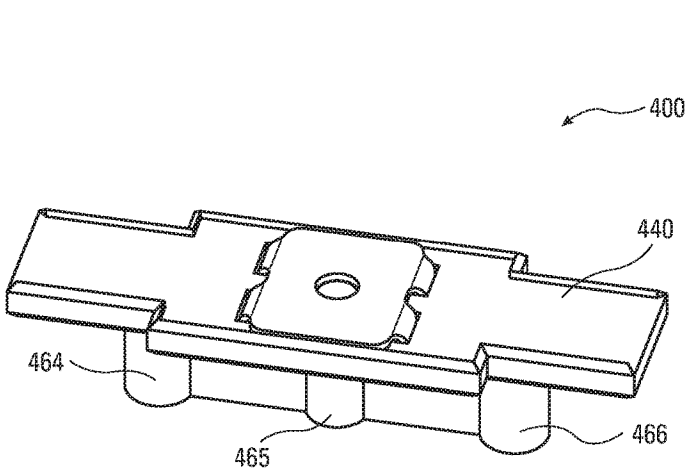
Figure 4D:
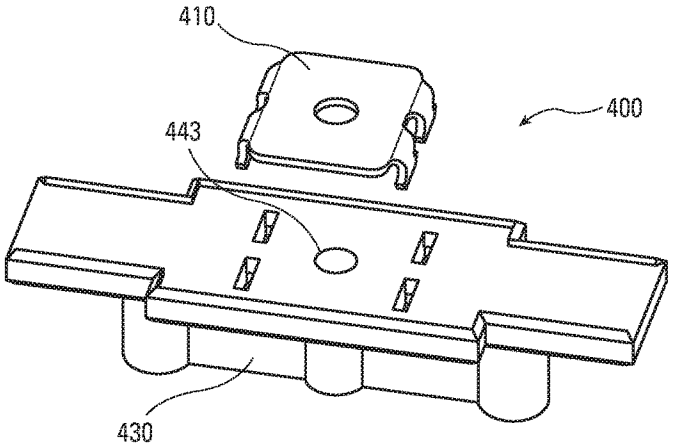
Figure 4D:
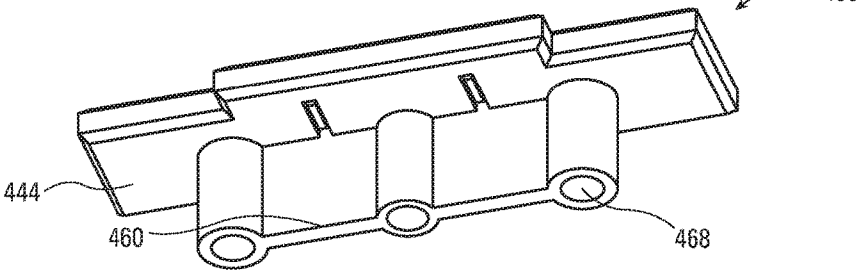

FIG. 1H is a cross-section of the deck board fastening device 100 shown in FIG. 1F along the lines H-H.

FIG. 1I is a cross-section of the deck board fastening device 100 shown in FIG. 1F along the lines I-I.

Suitable materials for the deck board fastening device body 130 include, but are not limited to plastic, polyvinylchloride (PVC), acrylic, polycarbonate, and composites thereof. However, other materials may be used without departing from the scope of the disclosure.

FIGS. 2A-E illustrate another configuration for a deck board fastening device 200. The clip 210 and deck board fastening device body 230 are configured similarly to the deck board fastening device 100 shown in FIG. 1. The perpendicularly positioned lower member 260, or keel, of the deck board fastening device 200 has one or more tubular ends 264, 266 extending from the lower surface 244 of the transverse upper member 240. The diameter across the tubular ends 264, 266 from the exterior surface is from 0.125 inches to 0.3125 inches, more preferably about 0.250 inches. The tubular ends 264, 266 can further be configured to define a hollowed tubular center 268 having a diameter between 0.06 inches and 0.08 inches, more preferably about 0.077 inches.

FIGS. 3A-D illustrate another configuration for a deck board fastening device 300. The clip 310 has a deck board fastening device body 330 with a transverse planar member 340. This configuration illustrates two perpendicularly positioned lower members 360, 360', or keels, of the deck board fastening device 300 which extend from the lower surface 344 of the transverse upper member 340. The lower members can be rectangular in shape or have a stepped rectangular shape with a length and a height and a first width at a first end and a second width at a second end that is different than the first width. As illustrated, the first width is narrower at a first end near a center point of the transverse planar member 340 and the second width, greater than the first width, is wider at a second end that is an opposing second end of the lower member 360, 360'.

FIGS. 4A-D illustrate another configuration for a deck board fastening device 400. The clip 410 has a deck board fastening device body 430 with a transverse planar member 440. This configuration illustrates a perpendicularly positioned lower member 460, or keels, of the deck board fastening device 400 which extend from the lower surface 444 of the transverse upper member 440. The lower member 460 can have one or more tubular ends 464, 466 extending from the lower surface 444 of the transverse upper member 440 and forming part of the lower member 460. A central tubular member 465 can be provided with an aperture therethrough to receive an anchoring device through the transverse planar member 440 and clip 410. The tubular ends 464, 466 can further be configured to define a hollowed tubular center 468. The thickness of the tubular ends 464, 466 defining the hollowed tubular center 468 can vary. Changes in thickness can impact a compressibility of the tubular ends when the deck board fastening device is positioned between two deck boards.

Figure 5B:
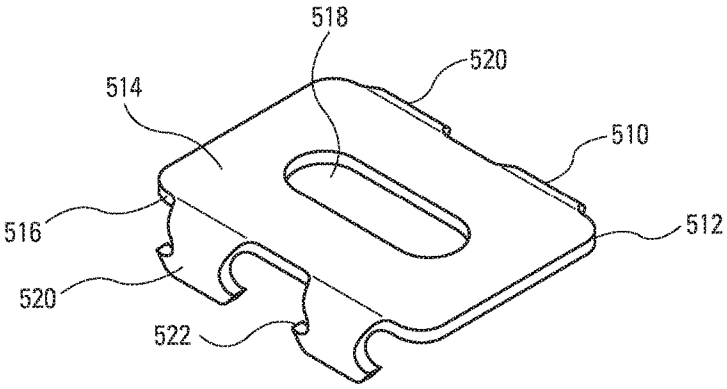
FIGS. 5A-C illustrate a clip from a top view (FIG. 5A), a top perspective view (FIG. 5B), and a side view (FIG. 5C)
Figure 5A:
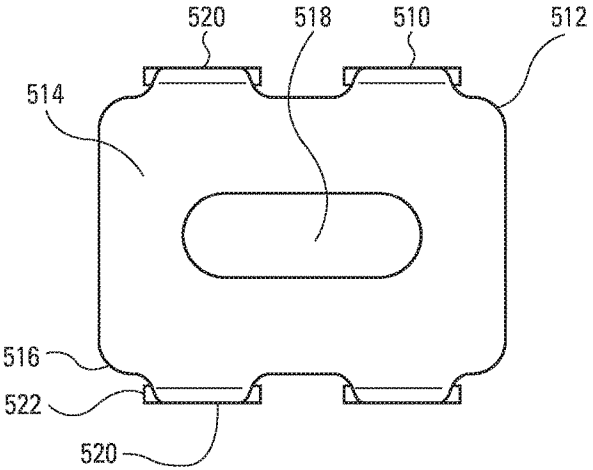
Figure 5C:
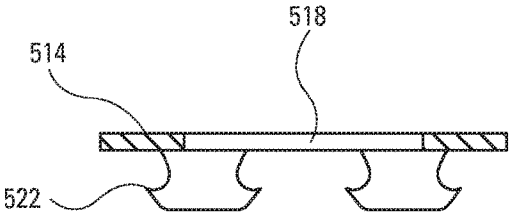

FIGS. 5A-C illustrate a clip 510 for use in combination with the deck board fastening devices disclosed herein. The clip 510 is shown from a top view, perspective view and side view. The clip 510 has a plate 512 with a planar upper surface 514 and a lower surface 516 and a clip aperture 518 positioned through the plate 512. Two or more clip anchors 520, 520' can extend from the plate 512. The two or more clip anchors 520, 520' can be integrally formed with the plate 512 such that one or more of the two or more anchors can be part of the clip 510 or can be formed such that the clip 510 operates as a single piece even where the one or more of the two or more clip anchors 520, 520' are formed from a separate piece which is adhered to the plate 512. The one or more clip anchors 520, 520' can have a notch 522 on one or both sides of each of the two or more clip anchors 520, 520'. The notch 522 is configured to secure the clip anchor 520 to the fastening device.

Figures 6A, 6B:
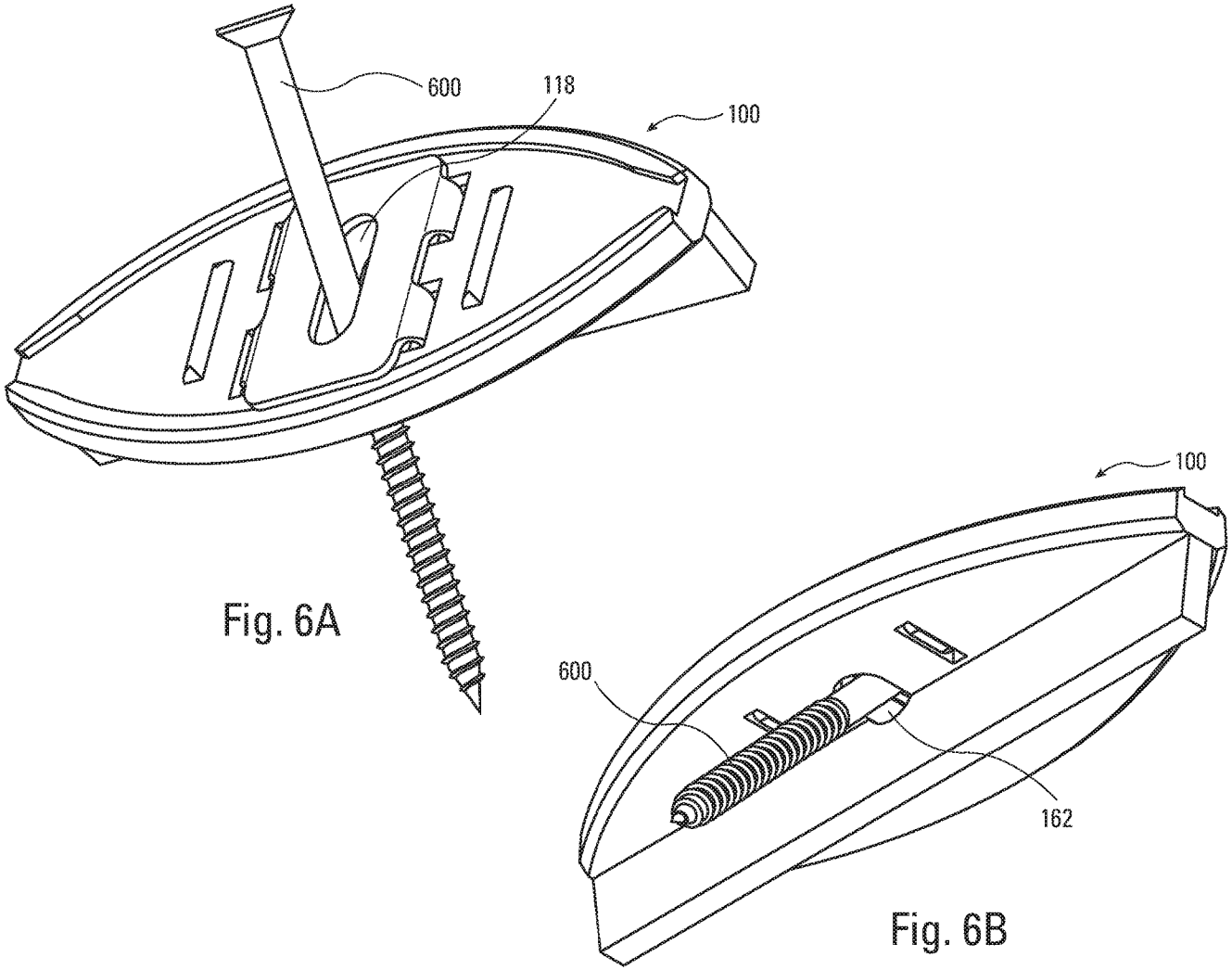
FIGS. 6A-B illustrate a deck board fastening device with an anchoring device from a top perspective view (FIG. 6A) and a bottom perspective view (FIG. 6B)

FIGS. 6A-B illustrate a deck board fastening device 100 of FIG. 1 with an anchoring device 500 such as a screw. As illustrated the anchoring device 600 passes through the clip aperture 118 and the central aperture at an angle. As shown in FIG. 6B the anchoring device 600 passes across a surface of the guide member 162 which guides the angle at which the anchoring device 600 passes through the deck board fastening device 100 and into a joist (not shown).

Figures 7A, 7B:
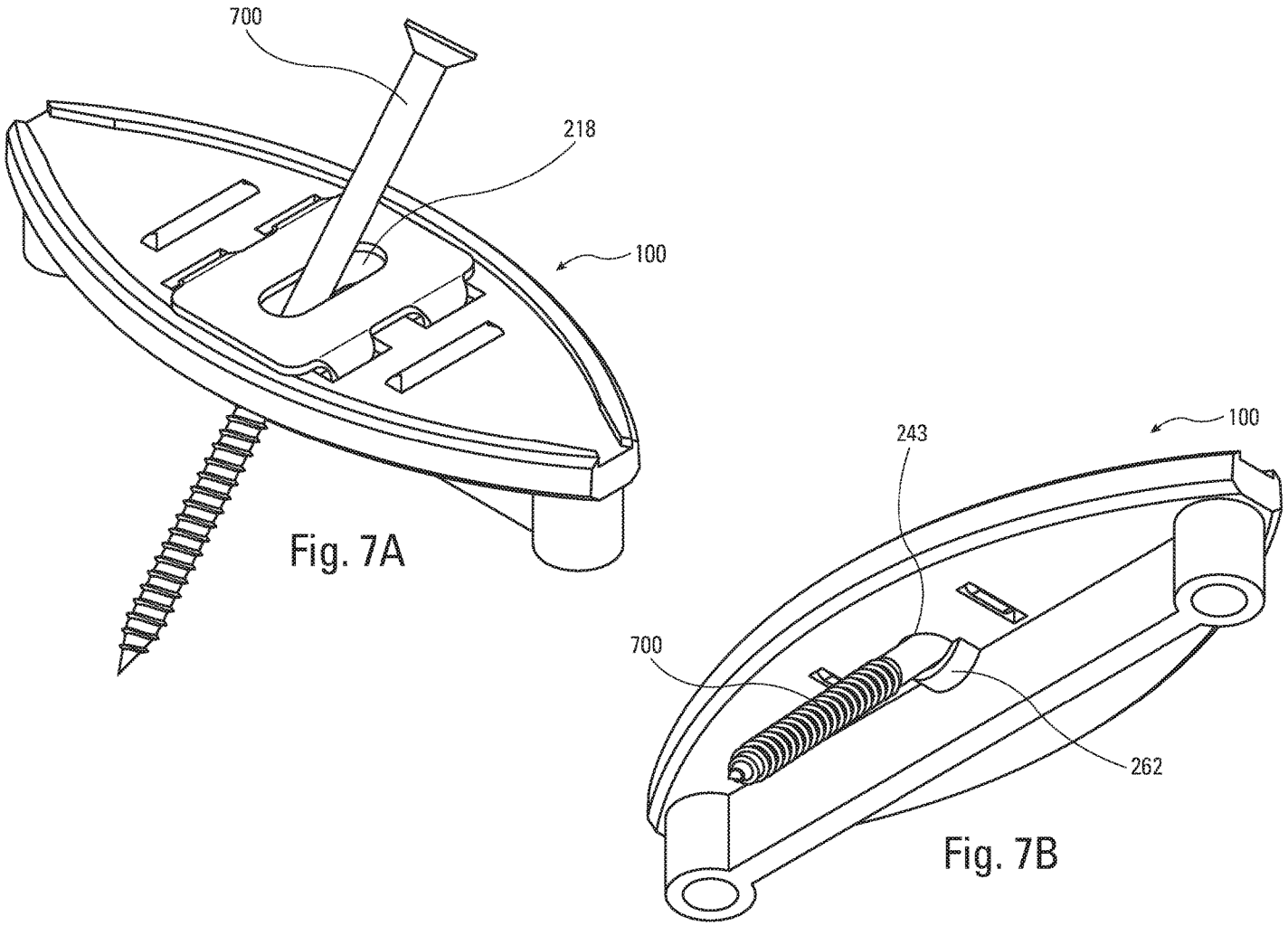
FIGS. 7A-B illustrate a deck board fastening device with an anchoring device from a top perspective view (FIG. 7A) and a bottom perspective view (FIG. 7B).

FIGS. 7A-B illustrate a deck board fastening device 200 of FIG. 2 with an anchoring device 700. As illustrated the anchoring device 700 passes through the clip aperture 218 and the central aperture 243 at an angle. As shown in FIG. 7B the anchoring device 700 passes across a surface of the guide member 262 which guides the angle at which the anchoring device 700 passes through the deck board fastening device 200 and into a joist (not shown).

A suitable method for making the anchoring device described above, includes the steps of: placing a starting piece into a stamping machine; stamping one or more clips from the starting plate and forming the starting plate into a clip of either the configuration shown in FIG. 1 or FIG. 5. Additionally a plurality of suitable apertures are stamped into the one or more clips, wherein each aperture has a lower portion communicating with an upper portion. A central aperture is also stamped through the starting piece. Additionally, the apertures in the starting piece can be configured so that the through bore is wider at an upper surface diameter than the lower surface diameter. As will be appreciated by those of skill in the art, the order of stamping the starting pieces to form the clips can be, for example, to stamp the central aperture and the secondary apertures first and then stamp the overall shape of the plate; or stamp the plate first and then stamp the central aperture and secondary apertures through the plate.

The device body can be made by injecting an injectable material into an injection molding machine to form one or more anchoring devices.

Kits are also contemplated which include one or more anchoring devices. The one or more anchoring devices may be releasably connected such that the anchoring devices are separated during the installation process. Additionally fasteners may be provided as part of the kit. In some configurations, a fastener is positioned through each central aperture of a provided anchoring device.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A method of assembling a deck structure, the method comprising:

providing a joist member;

providing a plurality of deck boards, each deck board having laterally opposing side edges with a groove therein arranged to span across the joist member parallel and laterally adjacent to one another and transversely to the longitudinal direction of the joist member;

providing one or more deck clips, wherein each of the one or more deck clips comprises a body having a transverse upper member with an upper surface and a lower surface, a perpendicular member extending from the lower surface of the upper member, a central aperture through the transverse upper member, two or more clip anchor apertures positioned about the central aperture, and a planar surface section on the upper surface of the transverse upper member between the central aperture and the two or more clip anchor apertures, and a clip having an upper surface and a lower surface, a central clip aperture therethrough, and two or more clip anchors positioned along at least one edge of the clip and extending downward away from the lower surface of the clip, wherein the clip anchor apertures receive the clip anchors when the central aperture of the transverse upper member corresponds at least partially with the central clip aperture and the lower surface of the clip engages the planar surface section of the upper surface of the transverse upper member;

positioning a portion of the transverse upper member of the deck clip in the groove in the board; and securing the deck clip to the joist by passing a fastening device through the clip aperture and the central aperture.

2. The method of claim 1, wherein the body of the deck clip is formed of a first material and the clip is formed of a second material.

3. The method of claim 1, wherein the deck clip is generally T-shaped as viewed in a side view of the deck clip.

4. The method of claim 1, wherein the transverse upper member of the deck clip has a shape selected from biscuit, bowtie, rectangular, and oval.

5. The method of claim 1, wherein a first axis of the transverse upper member of the deck clip is longer than a second perpendicular axis of the transverse upper member of the decking clip.

6. The method of claim 1 wherein the deck clip further comprises one or more stabilizers extending from the upper surface of the transverse upper member which are substantially perpendicular to a plane formed by the perpendicular member.

7. The method of claim 1 wherein the deck clip further comprises a second perpendicular member extending from the lower surface of the body.

8. The method of claim 1 wherein the perpendicular member of the deck clip extending from the lower surface of the body has a uniform thickness.

9. The method of claim 1 wherein the perpendicular member of the deck clip extending from the lower surface of the body has a first thickness at a first end and a second thickness at a second end.

10. The method of claim 1 wherein the perpendicular member extending from the lower surface of the body has a rounded first end and a rounded second end.

11. The method of claim 1 wherein the deck clip further comprises a tubular member extending from the lower surface of the body along a length of the perpendicular member.

12. The method of claim 1 wherein the deck clip further comprises a guide member extending from the lower surface of the body adjacent the perpendicular member and the central aperture.

* * * * *